US011087687B2

(12) United States Patent
Hong et al.

(10) Patent No.: US 11,087,687 B2
(45) Date of Patent: Aug. 10, 2021

(54) DISPLAY DEVICE AND DRIVING METHOD FOR THE SAME

(71) Applicant: LG DISPLAY CO., LTD., Seoul (KR)

(72) Inventors: Mookyoung Hong, Jinhae-si (KR); Nari Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 80 days.

(21) Appl. No.: 15/685,445

(22) Filed: Aug. 24, 2017

(65) Prior Publication Data

US 2018/0061321 A1 Mar. 1, 2018

(30) Foreign Application Priority Data

Aug. 31, 2016 (KR) ..... 10-2016-0111620

(51) Int. Cl.
*G09G 3/3233* (2016.01)
*G09G 3/3241* (2016.01)
*G09G 3/3258* (2016.01)

(52) U.S. Cl.
CPC ..... *G09G 3/3241* (2013.01); *G09G 3/3233* (2013.01); *G09G 3/3258* (2013.01);
(Continued)

(58) Field of Classification Search
CPC .. G09G 3/3241; G09G 3/3233; G09G 3/3258; G09G 2320/0295;
(Continued)

(56) References Cited

U.S. PATENT DOCUMENTS

2001/0024186 A1* 9/2001 Kane ..... G09G 3/3291 345/98
2003/0122813 A1* 7/2003 Ishizuki ..... G09G 3/3233 345/211
(Continued)

FOREIGN PATENT DOCUMENTS

CN 1703731 A 11/2005
CN 101615379 A 12/2009
(Continued)

OTHER PUBLICATIONS

Notification of the Second Office Action dated Jun. 12, 2020, issued in corresponding Chinese Patent Application No. 201710743188.2.
(Continued)

*Primary Examiner* — Patrick N Edouard
*Assistant Examiner* — Douglas M Wilson
(74) *Attorney, Agent, or Firm* — Morgan, Lewis & Bockius LLP

(57) ABSTRACT

A display device includes a display panel, a driver IC, and a control circuit. The control circuit includes operation circuitry to calculate the magnitude of a driving current flowing in a first pixel column in response to first voltage information from the driver IC, where the first voltage information corresponding to a voltage level of a first power supply line applied to a first pixel group of the display panel. The operation circuitry also calculates a compensation gain by comparing the magnitude of the driving current with preset current information. Further, the control circuit includes a compensator to receive a first data signal, generate a second data signal by applying the compensation gain to the first data signal, and transfer the second data signal to the driver IC. The display device and driving method may suppress image quality degradation by monitoring a high-potential voltage and correcting a data signal.

20 Claims, 8 Drawing Sheets

(52) U.S. Cl.
CPC ..... *G09G 2300/0842* (2013.01); *G09G 2320/029* (2013.01); *G09G 2320/0242* (2013.01); *G09G 2320/0295* (2013.01); *G09G 2320/043* (2013.01); *G09G 2320/0693* (2013.01)

(58) Field of Classification Search
CPC ..... G09G 2320/043; G09G 230/0693; G09G 2300/0842; G09G 2320/0242; G09G 2320/029; G09G 3/3208
See application file for complete search history.

(56) References Cited

U.S. PATENT DOCUMENTS

| | | | | |
|---|---|---|---|---|
| 2009/0309818 | A1 | 12/2009 | Kim et al. | |
| 2012/0306947 | A1 | 12/2012 | Kim et al. | |
| 2013/0021389 | A1* | 1/2013 | Odawara | G09G 3/3233 345/690 |
| 2013/0176349 | A1* | 7/2013 | Park | G09G 3/3291 345/690 |
| 2016/0025791 | A1* | 1/2016 | Bae | G01R 31/52 324/764.01 |
| 2017/0039933 | A1* | 2/2017 | Shin | G09G 3/3225 |
| 2017/0193909 | A1* | 7/2017 | Song | G09G 3/2074 |
| 2017/0294160 | A1* | 10/2017 | Ono | G09G 3/3233 |

FOREIGN PATENT DOCUMENTS

| | | | |
|---|---|---|---|
| CN | 101976546 | A | 2/2011 |
| CN | 102810293 | A | 12/2012 |
| CN | 105096834 | A | 11/2015 |
| WO | 2011/118124 | A1 | 9/2011 |
| WO | 2016035295 | A1 | 3/2016 |

OTHER PUBLICATIONS

Notification for Grant of Patent for Invention dated Nov. 19, 2020, issued in corresponding Chinese Patent Application No. 201710743188.2.

* cited by examiner

DISPLAY DEVICE AND DRIVING METHOD FOR THE SAME

CROSS-REFERENCE TO RELATED APPLICATIONS

This application claims priority from Korean Patent Application No. 10-2016-0111620, filed on Aug. 31, 2016, which is hereby incorporated by reference for all purposes as if fully set forth herein.

BACKGROUND

Technical Field

The present disclosure relates to a display device and a driving method for the same.

Description of the Related Art

With progress of the information-oriented society, various types of demands for display devices for displaying an image are increasing. Various types of display devices, such as a liquid crystal display device LCD, a plasma display device, and an organic light emitting display device (an "OLED" display device) have been used.

From among these display devices, the organic light emitting diode ("OLED") of an OLED display device displays an image by emitting a light in response to the flow of a driving current driven in a driving transistor. The amount of the driving current may vary depending on a high-potential voltage supplied to the driving transistor and a voltage corresponding to a data signal. Also, the driving transistor may have a variation in threshold voltage. Even if the same signal is transferred to the driving transistors of different pixels, the variation in threshold voltage may cause a difference in the amount of a driving current, resulting in a difference in the amount of emitted light between pixels. Thus, the image quality of the OLED display device may be non-uniform, which may result in degradation of image quality.

Therefore, the OLED display device may sense a variation in threshold voltage and compensate the variation to solve the above-described problem.

Also, the OLED display device drives a current in the driving transistor in response to a high-potential voltage supplied to a pixel. Thus, if a voltage level of the high-potential voltage is changed, the amount of the current driven in the driving transistor is changed, and, thus, the image quality may be degraded. Therefore, a method for compensating the degradation of image quality caused by a decrease in high-potential voltage during driving of the OLED is needed.

Further, the amount of current flowing may vary depending on a temperature. For example, a temperature within the OLED may be increased due to a change in ambient temperature or long-term use, and thus, the amount of current flowing in the OLED may be changed. Particularly, if the amount of current flowing in a power supply line that supplies a high-potential voltage varies depending on a temperature change, of the level of a high-potential voltage to be applied to the power supply line may be decreased. Such a difference in high-potential voltage may cause a change in current flowing in a pixel, and thus cause the degradation of image quality.

SUMMARY

An aspect of the present disclosure provides a display device capable of sensing a voltage and thus suppressing the degradation of image quality and also provides a driving method for the same.

Another aspect of the present disclosure provides a display device capable of suppressing the degradation of image quality caused by an increase in temperature and also provides a driving method for the same.

According to an aspect of the present disclosure, there is provided a control circuit for a display device including a display panel and a driver integrated circuit (IC), the control circuit comprising: an operation circuitry configured to calculate the magnitude of a driving current flowing in a first pixel column in response to first voltage information from the driver IC, wherein the driver IC is configured to sense the first voltage information corresponding to a voltage level of a first power supply line, the first power supply line configured to apply a high-potential voltage to a first pixel group including at least one pixel of the display panel, and calculate a compensation gain by comparing the calculated magnitude of the driving current with preset current information; and a compensator configured to receive a first data signal from outside the control circuit, generate a second data signal by applying the compensation gain to the first data signal, and transfer the second data signal to the driver IC.

According to another aspect of the present disclosure, there is provided a display panel that includes a first pixel group including at least one pixel, a second pixel group including at least another pixel, a first power supply line configured to apply a high-potential voltage to the first pixel group, and a second power supply line configured to apply the high-potential voltage to the second pixel group; a first driver integrated circuit (IC) configured to output first voltage information by sensing a voltage level of the first power supply line and control the amount of a driving current flowing in the at least one pixel included in the first pixel group; and a control circuit configured to calculate the magnitude of the driving current flowing in the first pixel group using the first voltage information, calculate a compensation gain by comparing the calculated magnitude of the driving current with preset current information, receive a first data signal from outside the control circuit and generate a second data signal by applying the compensation gain to the first data signal, and transfer the second data signal to the first driver IC.

According to yet another aspect of the present disclosure, there is provided a driving method for a display device including a display panel that includes a first pixel group including at least one pixel, a second pixel group including at least another pixel, a first power supply line configured to apply a high-potential voltage to the first pixel group, and a second power supply line configured to apply the high-potential voltage to the second pixel group, the driving method comprising: calculating the amount of a driving current flowing in the first pixel group by sensing a voltage applied to the first power supply line; calculating a compensation gain by comparing the calculated amount of the driving current flowing in the first pixel group with a preset amount of current; and compensating a data signal in response to the calculated compensation gain.

According to the present example embodiments described above, it is possible to provide a display device capable of suppressing the degradation of image quality during use by monitoring a high-potential voltage and thus correcting a data signal and also provide a driving method for the same.

Further, according to the present example embodiments described above, it is possible to provide a display device capable of correcting the amount of current using an ADC previously installed in a driver IC without a separate temperature sensor even when an ambient temperature is changed and thus reducing manufacturing costs and also provide a driving method for the same.

It is to be understood that both the foregoing general description and the following detailed description are example and explanatory and are intended to provide further explanation of the disclosure as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain the various principles. In the drawings.

DETAILED DESCRIPTION

Figure 1:
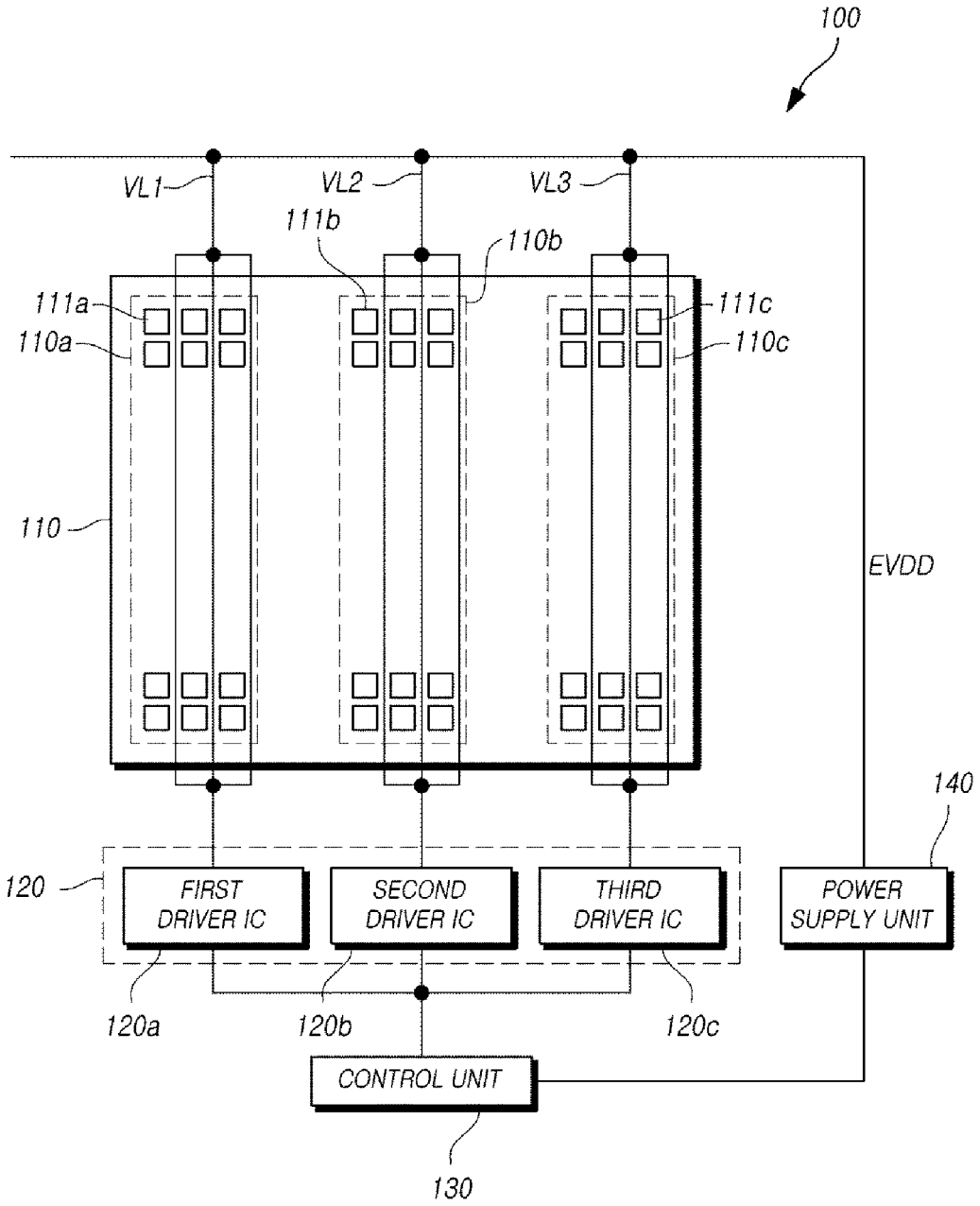
FIG. 1 is a configuration view illustrating an example of a display device according to the present example embodiment.

Hereinafter, embodiments of the present disclosure will be described in detail with reference to the accompanying drawings. When reference numerals refer to components of each drawing, although the same components are illustrated in different drawings, the same components are referred to by the same reference numerals as possible. Further, if it is considered that description of related known configuration or function may cloud the gist of the present disclosure, the description thereof will be omitted.

Further, in describing components of the present disclosure, terms such as first, second, A, B, (a), (b), etc. can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a configuration view illustrating an example of a display device according to the present example embodiment.

With reference to FIG. 1, a display device 100 may include a display panel 110, a power supply unit 140, a control unit 130, and a driver integrated circuit (IC) 120.

The display panel 110 may include a plurality of pixels and may display an image with light emitted in response to a driving current flowing in each pixel. Also, the plurality of pixels may be divided into a first pixel group 110*a* including at least one pixel 111*a* from among the plurality of pixels, a second pixel group 110*b* including at least another pixel 111*b* which is not included in the first pixel group 110*a* from among the plurality of pixels, and a third pixel group 110*c* including at least another pixel 111*c* which is not included in the first and second pixel groups 110*a* and 110*b* from among the plurality of pixels. A pixel group may be a set of pixels that receive a signal from the same driver IC from among a plurality of driver ICs. Further, a driving current may be a current that flows into each of pixels so as to emit a light, and may be the sum of driving currents flowing into pixels included in each pixel group.

The first pixel group to the third pixel group 110*a* to 110*c* may be respectively connected to a first power supply line VL1, a second power supply line VL2, and a third power supply line VL3 configured to supply a high-potential voltage. Also, each pixel in the display panel 110 may be connected to a gate line (not illustrated) and a data line (not illustrated) and may receive a data signal transferred through the data line in response to a gate signal transferred through the gate line. Further, in each pixel, the magnitude of a driving current flowing in the pixel may be determined according to a high-potential voltage EVDD received through any one of the first power supply line VL1, the second power supply line VL2, and the third power supply line VL3, and a data signal received through the data line. Furthermore, each pixel in the display panel 110 may receive a sensing signal from connection to a sensing signal line (not illustrated) and sense information about a threshold voltage and electron mobility of a driving transistor configured to drive a current to each pixel on the basis of the sensing signal. However, a signal received by each pixel is not limited thereto. Herein, the plurality of pixels in the display panel 110 is illustrated as being divided into the three groups, e.g., the first pixel group 110*a*, the second pixel group 110*b*, and the third pixel group 110*c*, but is not limited thereto.

The power supply unit 140 may generate the high-potential voltage EVDD and transfer the high-potential voltage EVDD to the display panel 110. The power supply unit 140 may apply the high-potential voltage EVDD to each of the first pixel group to the third pixel group 110*a* to 110*c* of the display panel 110. Also, a voltage level of the high-potential voltage EVDD supplied from the power supply unit 140 to the display panel 110 may drop when a current flows. Particularly, a voltage drop may occur in response to a current flowing from a voltage applied by the power supply unit 140 to at least any one of the first power supply line VI1 to the third power supply line VL3. Herein, the power supply unit 140 may be a DC-DC converter, but is not limited thereto.

The control unit 130 may calculate the amount of a driving current flowing in the display panel 110 using the information about the voltage level of the high-potential voltage EVDD applied to the pixels, and determine whether the image quality is degraded or not by comparing the calculated amount of the driving current with a preset amount of the driving current. Further, if it is determined that the image quality is degraded, the control unit 130 may compensate a data signal to reduce a difference between the calculated amount of the driving current and the preset amount of the driving current.

An OLED emits a light corresponding to the amount of driving current flowing. In an example where pixels each include OLED(s) that express three colors, e.g., R, G, and B, or four colors, e.g., R, G, B, and W, when the amount of a driving current flowing in OLEDs is changed, the degradation of image quality such as color coordinate deviation may occur. Also, the flow of a driving current generated in a pixel corresponds to a voltage level of the high-potential voltage EVDD applied to the pixel. Where the amount of a driving current flowing in a power supply line VL configured to supply the voltage level of the high-potential voltage EVDD is higher than a preset value, a voltage level of the power supply line VL to be applied with the high-potential voltage EVDD is decreased. Thus, the amount of the driving current generated in a pixel may be changed. Further, because the flow of a current may vary depending on a temperature, the amount of current flowing in the power supply line VL configured to supply the voltage level of the high-potential voltage EVDD may be changed according to a change in ambient temperature. Therefore, the color coordinates of an image displayed on the display panel 110 may deviate in response to a change in ambient temperature.

The control unit 130 may compensate a data signal on the basis of a result of sensing a voltage level applied to the power supply line VL configured to supply the voltage level of the high-potential voltage EVDD, thereby suppressing degradation of the image quality of the display panel 110.

If a difference between the voltage level of the high-potential voltage EVDD and the preset voltage is equal to or lower than a predetermined value, the control unit 130 may determine that the driving current flows within the normal range. If the difference between the voltage level of the measured high-potential voltage EVDD and the preset voltage is equal to or higher than the predetermined value, the control unit 130 may determine that the driving current does not flow within the normal range, and compensate a data signal on the basis of the difference between the voltage level of the measured high-potential voltage EVDD and the voltage level of the preset voltage. If the difference between the voltage level of the measured high-potential voltage EVDD and the preset voltage is much higher than the predetermined value, the control unit 130 may determine that an overcurrent flows in the display panel 110, and thus determine that the display panel 110 has broken down.

Therefore, because the control unit 130 can detect a change in the amount of current caused by a temperature change using a change in voltage level of a high-potential voltage, the display device 100 can suppress the degradation of image quality caused by a change in ambient temperature without using a separate temperature sensor. Thus, the manufacturing costs of the display device can be reduced.

Herein, the control unit 130 may also be referred to as a control block. In an example embodiment, the control unit 130 may be a timing controller or a part of the timing controller, but embodiments are not limited thereto. Furthermore, the control unit 130 may receive an image signal corresponding to a digital signal from an external device (not illustrated) and transfer the image signal to the driver IC 120. The image signal received from the external device may be referred to as a first data signal. Further, an image signal received by the control unit 130 from the external device and then compensated by a compensation gain may be referred to as a second data signal. An image signal compensated and corrected by sensing a voltage level of a high-potential voltage and calculating a compensation gain may also be referred to as a second data signal and an image signal corrected using any variables other than voltage level of a high-potential voltage may be referred to as a first data signal.

The driver IC 120 may sense a voltage of the power supply line VL to be applied with the voltage level of the high-potential voltage EVDD for transfer to the plurality of pixels in the display panel 110. Also, the driver IC 120 may transfer a gate signal and a data signal to a gate line and a data line to which it is connected. Further, the driver IC 120 may be connected to a sensing line (not illustrated) and may receive a threshold voltage and electron mobility of the driving transistor through the sensing line. The driver IC 120 may include a digital to analog converter (DAC, not illustrated), and the DAC may convert a data signal, transferred in the form of a digital image signal from the control unit 130, into an analog signal, and then transfer the analog signal to the data line. Further, the driver IC 120 may include an analog to digital converter (ADC, not illustrated) and may calculate information about a voltage level of the high-potential voltage EVDD and then transfer the information to the control unit 130. Also, the ADC may transfer the threshold voltage and the electron mobility of the driving transistor received through the sensing line to the control unit 130.

Furthermore, the driver IC 120 may include a first driver IC 120*a* configured to sense a voltage applied to the first power supply line VL1 to which is transferred a voltage level of the high-potential voltage EVDD to be transferred to the first pixel group 110*a* of the display panel 110, a second driver IC 120*b* configured to sense a voltage applied to the second power supply line VL2 to which is transferred a voltage level of the high-potential voltage EVDD to be transferred to the second pixel group 110*b*, and a third driver IC 120*c* configured to sense a voltage applied to the third power supply line VL3 to which is transferred a voltage level of the high-potential voltage EVDD to be transferred to the third pixel group 110*c*. Also, the first driver IC 120*a* to the third driver IC 120*c* may be connected to the data line and the gate line, and may transfer a data signal and a gate signal to the first pixel group to the third pixel group 110*a* to 110*c*, respectively.

Figure 2:
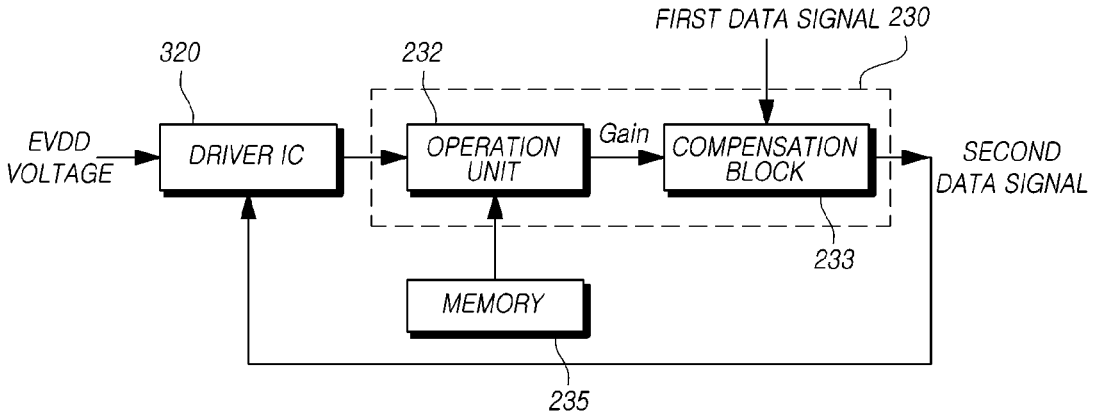
FIG. 2 is a configuration view illustrating a first example of a connection relationship between a control unit and a driver IC illustrated in FIG. 1.

FIG. 2 is a configuration view illustrating a first example of a connection relationship between the control unit and the driver IC illustrated in FIG. 1.

With reference to FIG. 2, a control unit 230 may be connected to a driver IC 320 and may thus receive voltage information about a voltage level of a voltage to be applied to a power supply line from the driver IC 320. The driver IC 320 may sense a voltage of the first power supply line VL1 configured to apply the high-potential voltage EVDD to the control unit 230, and generate first voltage information about the voltage of the first power supply line and then transfer the first voltage information to the driver IC 320.

Further, the control unit 230 may include an operation unit 232 and a compensation block 233. The operation unit 232 may receive the first voltage information from the driver IC 320, which senses the first voltage information corresponding to a voltage level of the first power supply line VL1 configured to apply the high-potential voltage EVDD to the first pixel group 110*a* including at least one pixel of the display panel 110 illustrated in FIG. 1. Also, the control unit 230 may calculate the magnitude of a driving current flowing in a first pixel column in response to the first voltage information and calculate a compensation gain by comparing the calculated magnitude of the driving current with preset current information. Further, the compensation block 233 may generate a second data signal by applying the compensation gain to a first data signal received from the outside and transfer the second data signal to the driver IC 320.

Further, the operation unit 232 may be connected to a memory 235. The memory 235 may store a reference amount of current corresponding to a preset driving current, and the operation unit 232 may compare the amount of current corresponding to the calculated amount of the driving current with the reference amount of current stored in the memory 235 using the information about the voltage level of the first power supply line VL1, and then calculate a difference. Then, the operation unit 232 may calculate a compensation gain using the difference.

While a display panel of a manufactured display device is driven during a manufacturing process, a variation in driving current may be adjusted by taking a picture of the display panel and then determining the image quality of the display panel. Such a process of adjusting a variation in driving current may be referred to as optical compensation. In an example embodiment, the reference amount of current stored in the memory 235 may be the amount of a driving current flowing in the display panel in a state where a variation in image quality is adjusted by the optical compensation. Therefore, the display panel that compensates a data signal using a variation in the high-potential voltage EVDD during use enables the optically compensated luminance to be maintained.

Figure 3:
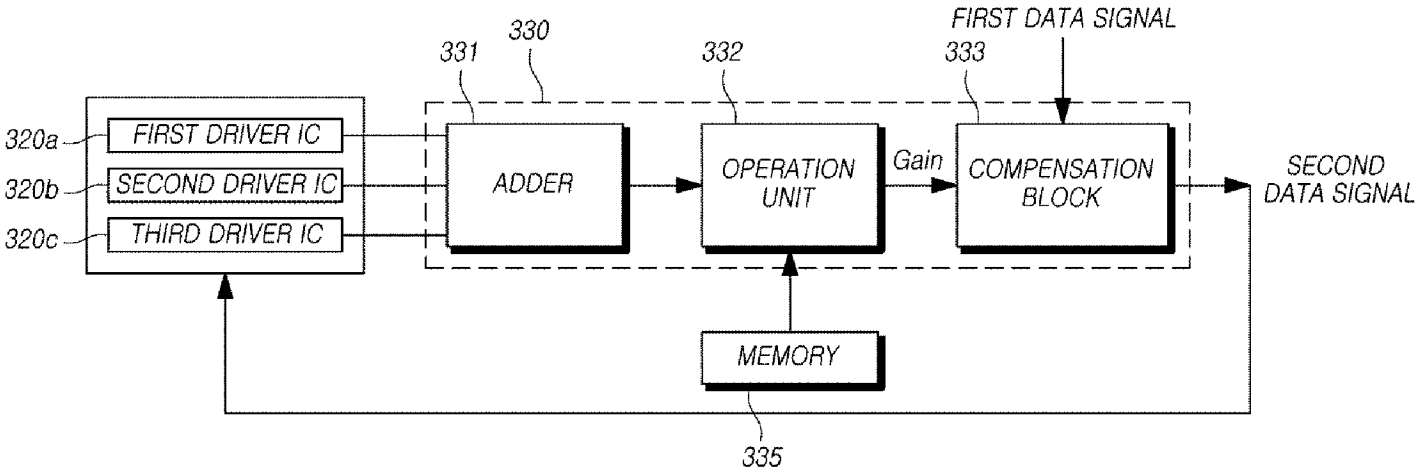
FIG. 3 is a configuration view illustrating a second example of a connection relationship between the control unit and the driver IC illustrated in FIG. 1.

FIG. 3 is a configuration view illustrating a second example of a connection relationship between the control unit and the driver IC illustrated in FIG. 1.

With reference to FIG. 3, the control unit 130 may be connected to a plurality of driver ICs 320*a*, 320*b*, and 320*c*. A first driver IC 320*a* from among the plurality of driver ICs 320*a*, 320*b*, and 320*c* may sense a voltage level of the first power supply line VL1 to be applied with the high-potential voltage EVDD and generate first voltage information about the voltage level of the first power supply line VL1, a second driver IC 320*b* may sense a voltage level of the second power supply line VL2 to be applied with the high-potential voltage EVDD and generate second voltage information about the voltage level of the second power supply line VL2, and a third driver IC 320*c* may sense a voltage level of the third power supply line VL3 to be applied with the high-potential voltage and generate third voltage information about the voltage level of the third power supply line VL3, and then transfer the information to the driver IC 120. Herein, each of the first power supply line VL1, the second power supply line VL2, and the third power supply line VL3 may receive the high-potential voltage EVDD from the power supply unit 140 illustrated in FIG. 1.

Further, a control unit 330 may include an operation unit 332 and a compensation block 333. The operation unit 332 may receive the first voltage information from the first driver IC 320*a* that senses the first voltage information corresponding to the voltage level of the first power supply line VL1 configured to apply the high-potential voltage EVDD to the first pixel group 110*a* of the display panel 110 illustrated in FIG. 1, the second voltage information from the second driver IC 320*b* that senses the second voltage information corresponding to the voltage level of the second power supply line VL2 configured to apply the high-potential voltage EVDD to the second pixel group 110*b*, and third voltage information from the third driver IC 320*c* that senses the third voltage information corresponding to the voltage level of the third power supply line VL3 configured to apply the high-potential voltage EVDD to the third pixel group 110*c*. Furthermore, the control unit 330 may calculate an accumulative driving current by adding up the magnitude of a driving current flowing in the first pixel group 110*a* illustrated in FIG. 1 in response to the first voltage information, the magnitude of a driving current flowing in the second pixel group 110*b* in response to the second voltage information, and the magnitude of a driving current flowing in the third pixel group 110*c* in response to the third voltage information, and calculate a compensation gain by comparing the magnitude of the calculated accumulative driving current with preset current information. Also, the compensation block 333 may generate a second data signal by applying the compensation gain to a first data signal received from the outside and then transfer the second data signal to the driver IC 120.

Further, the operation unit 332 may further include an adder 331 that receives the first voltage information, the second voltage information, and the third voltage information from the first to third driver ICs 120*a* to 120*c*, respectively, and adds them up. Thus, the operation unit 332 may receive voltage information obtained by adding up the first voltage information, the second voltage information, and the third voltage information from the adder 331 and then calculate the magnitude of the accumulative driving current and calculate a compensation gain by comparing the accumulative driving current with the preset current information. Thus, the compensation gain can be calculated using the amount of a driving current flowing in more pixels of the display panel. Therefore, the compensation gain can be calculated more accurately and the image quality of the display panel may be less degraded.

Further, the operation unit 332 may be connected to a memory 335. The memory 335 may store a reference amount of current corresponding to a preset driving current, and the operation unit 332 may compare the amount of current corresponding to the calculated accumulative driving current with the reference amount of current stored in the memory 335 and then calculate a difference. Then, the operation unit 332 may calculate a compensation gain using the difference between the amount of current corresponding to the accumulative driving current and the reference amount of current.

After the display device 100 illustrated in FIG. 1 is manufactured, a variation in driving current may be adjusted by taking a picture of the display device 100. Such a process of adjusting a variation in driving current may be referred to as optical compensation. The reference amount of current stored in the memory 335 may be the amount of a driving current flowing in the display panel 110 in a state where optical compensation is completed and a variation is adjusted. Therefore, the compensated display panel 110 enables the optically compensated luminance to be maintained.

Figure 4:
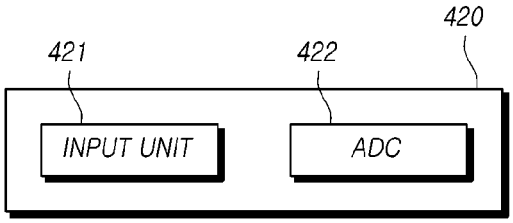
FIG. 4 is a configuration view illustrating a first example of the driver IC illustrated in FIG. 2.

FIG. 4 is a configuration view illustrating a first example of the driver IC illustrated in FIG. 2.

With reference to FIG. 4, a driver IC 420 may include an input unit 421 and an ADC 422.

The input unit 421 may receive a voltage level of a power supply line to be applied with the high-potential voltage EVDD, and the ADC 422 may receive the voltage level of the power supply line from the input unit 421 and then generate a sensing signal corresponding to the received voltage level of the power supply line. Also, the input unit 421 may convert the magnitude of the received voltage level of the power supply line into a voltage which can be converted by the ADC 422. Assuming the magnitude of the high-potential voltage EVDD is 26 V and the ADC 422 can convert a voltage of 0 V to 10 V into a digital signal, a voltage of 26 V may be transferred to the input unit 421, and the transferred voltage of 26 V may be reduced to 10 V through voltage division. Then, the reduced voltage of 10 V may be converted into a digital signal by the ADC 422, and the ADC 422 may output a sensing signal corresponding to the high-potential voltage using the digital signal.

Figure 5:
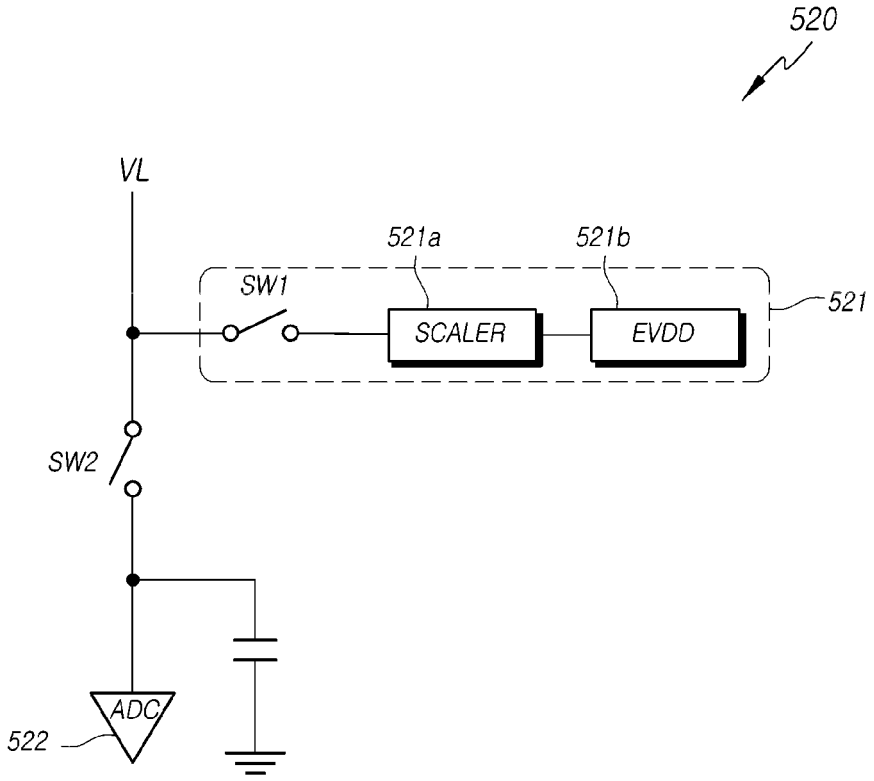
FIG. 5 is a circuit diagram illustrating a second example of the driver IC illustrated in FIG. 2.

FIG. 5 is a circuit diagram illustrating a second example of the driver IC illustrated in FIG. 2.

With reference to FIG. 5, a driver IC 521 may include a first terminal 521*b* that receives a voltage level of a power supply line to be applied with the high-potential voltage EVDD, a scaler 521*a* that converts the high-potential voltage received from the first terminal 521*b* into a voltage which can be converted by an ADC 522, a first switch SW1 that switches the voltage generated in the scaler 521*a*, and a second switch SW2 that selectively transfers a signal to the ADC 522.

To sense and compensate a threshold voltage of a driving transistor of a pixel, the ADC 522 receives a sensing signal from a pixel and compensates an image signal digitally transferred in response to the received sensing signal in a state where the first switch SW1 is turned off and the second switch SW2 is turned on, and, thus, the degradation of image quality caused by a difference in threshold voltage can be suppressed. Also, in order to measure the voltage level of the power supply line to be applied with the high-potential voltage EVDD and calculate a compensation gain, a voltage generated in the scaler 521*a* is transferred to the ADC 522 and an image signal transferred in the form of a digital signal is corrected accordingly in a state where the first switch SW1 is turned off and the second switch SW2 is turned on, and, thus, the degradation of image quality can be suppressed.

Figure 6:
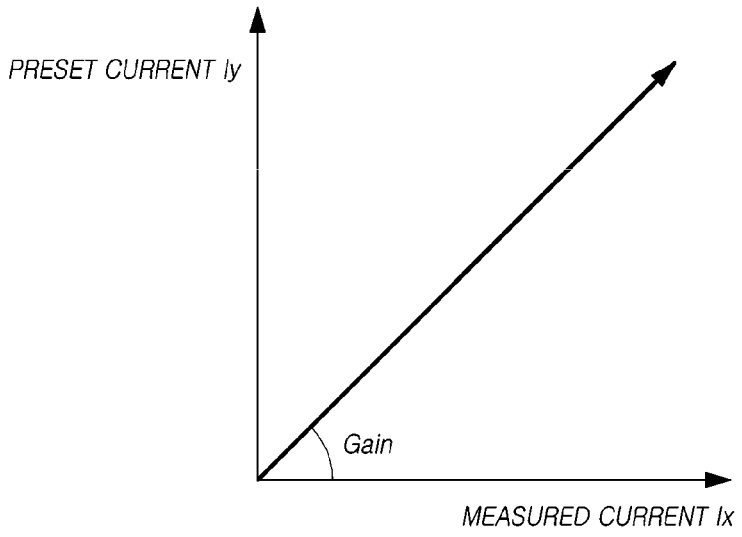
FIG. 6 is a graph showing a relationship between a preset current and a measured current.

FIG. 6 is a graph showing a relationship between a preset current and a measured current.

With reference to FIG. 6, a measured amount of current may be represented on an x axis and a preset amount of current may be represented on a y-axis. Further, a slope may represent a compensation gain. Therefore, the compensation gain may satisfy the following Equation 1.

$$\text{Compensation gain (\%)} = (\text{Preset amount of current}(Iy)/\text{Measured amount of current}(Ix)) \times 100 \quad \text{[Equation 1]}$$

Herein, the gain may refer to the compensation gain.

Further, an image signal may be corrected by operating the compensation gain obtained by using Equation 1 to a digital signal, and, thus, a data signal to be transferred to a data line can be corrected.

Figure 7:
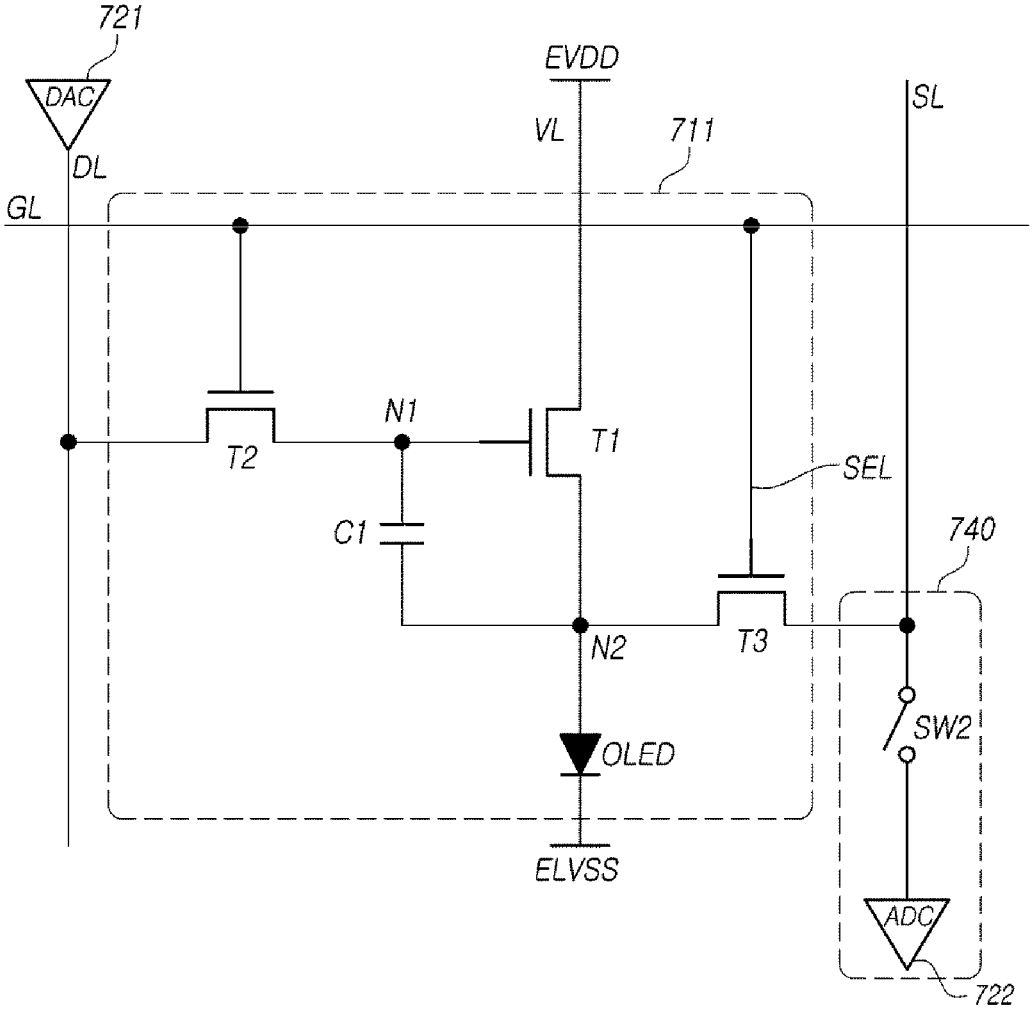
FIG. 7 is a circuit diagram illustrating an example of a pixel employed in the display device illustrated in FIG. 1.

FIG. 7 is a circuit diagram illustrating an example of a pixel employed in the display device illustrated in FIG. 1.

With reference to FIG. 7, a pixel 711 may include an OLED, first to third transistors T1 to T3, and a capacitor C1. Herein, the first transistor T1 may be a driving transistor that drives a driving current to the OLED.

In the first transistor T1, a first electrode may receive the high-potential voltage EVDD through connection to the power supply line VL, a second electrode may be connected to a second node N2, and a gate electrode may be connected to a first node N1. Further, in the second transistor T2, a first electrode may be connected to a data line DL, a second electrode may be connected to the first node N1, and a gate electrode may be connected to a gate line GL. Furthermore, in the third transistor T3, a first electrode may be connected to the second node N2, a second electrode may be connected to a sensing signal line SL, and a third electrode may be connected to a sensing control signal line SEL. Herein, the sensing signal line SL may be the gate line GL. Further, the capacitor C1 may be connected between the first node N1 and the second node N2. Furthermore, the data line DL and the sensing line SL connected to the pixel may be connected to a DAC 721 and an ADC 722, respectively, and the second switch SW2 may be connected between the sensing line and a line for the ADC 722.

Further, if an initialization signal is transferred through the data line DL in a state where a gate signal is transferred through the gate line GL, the pixel 711 may operate in an initialization mode so as to initialize a voltage stored in the capacitor C1. If the initialization mode is ended in a state where the gate signal is maintained through the gate line GL and a data signal is transferred to the first node N1 through the data line DL, it can be transferred when the pixel may operate in a display mode. The second switch SW2 can be maintained in an off state in the initialization mode and the display mode. Further, when the gate signal is converted from an on state to an off state through the gate line GL and the first switch SW1 is turned from on to off, the pixel 711 may operate in a sensing mode, and a threshold voltage and electron mobility of the first transistor T1 may be transferred through the sensing line to the ADC 722 connected to the sensing line.

Herein, the ADC 722 and the second switch SW2 may be a part of a driver IC 520 illustrated in FIG. 5. Therefore, while a threshold voltage of the first transistor T1 is compensated in the pixel 711, a voltage level of a power supply line to be applied with the high-potential voltage EVDD can be monitored by sensing the threshold voltage and the electron mobility of the first transistor T1. Thus, it is possible to sense the voltage level of the power supply line to be applied with the high-potential voltage EVDD without modifying a structure of the driver IC, and thus possible to suppress an increase in manufacturing costs of the display device.

Figure 8:
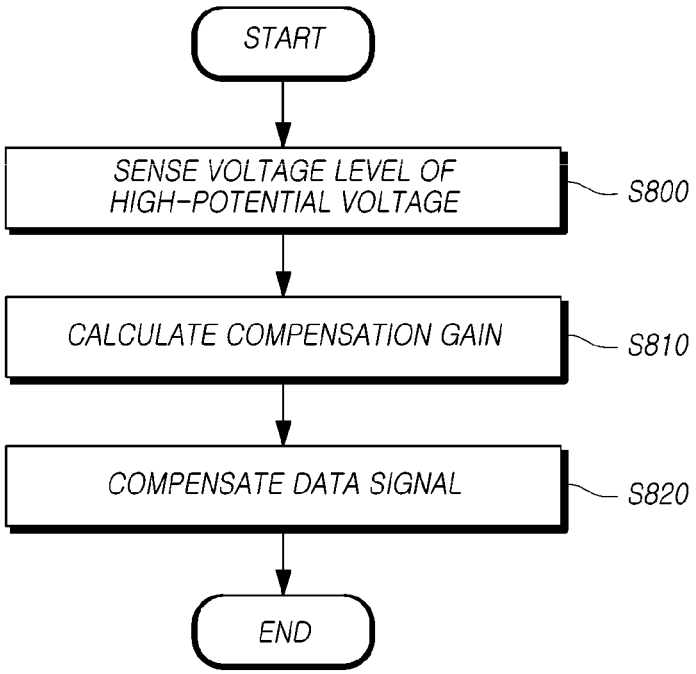
FIG. 8 is a flowchart showing a driving method for the display device illustrated in FIG. 1.

FIG. 8 is a flowchart showing a driving method for the display device illustrated in FIG. 1.

With reference to FIG. 8, a driving method for the display device may include measuring (sensing) a voltage of a power supply line to be applied with the high-potential voltage EVDD (S800), calculating a compensation gain (S810), and compensating a data signal (S820).

In the step of measuring the voltage of the power supply line to be applied with the high-potential voltage EVDD (S800), the amount of a driving current can be calculated using a voltage level of the first power supply line VL1 configured to supply the high-potential voltage EVDD to the measured pixel. Further, the display panel 110 may be driven to express a preset gray scale. In a state where the display panel 110 is driven, if a difference between the voltage level of the first power supply line VL1 and a preset voltage level is equal to or lower than a preset value, it may be determined that the driving current flows normally. Further, if the difference between the voltage level of the first power supply line VL1 and the preset voltage level is higher than the preset value, it may be determined that the driving current does not flow normally but flows excessively. Furthermore, if the difference between the voltage level of the first power supply line VL1 and the preset voltage level is much higher than the preset value, it may be determined that an overcurrent flows in the display device and driving of the display panel may be stopped. Thus, the image quality can be compensated by sensing the voltage of the power supply line to be applied with the high-potential voltage EVDD. Also, it is possible to suppress damage to the display panel caused by an overcurrent by suppressing the occurrence of the overcurrent.

If the voltage level of the first power supply line VL1 is lower than the preset voltage level and a difference between them is higher than the preset value, it is determined that the driving current does not flow normally but flows excessively and the step of calculating the compensation gain (S810) may be performed. In the step of calculating the compensation gain (S810), the compensation gain may be calculated by using a preset amount of current Iy and a measured amount of current Ix as shown in Equation 1. Further, when the compensation gain is calculated, the display panel may receive a data signal expressing a gray scale of 127 to measure the amount of current and compare the measured amount of current with a preset amount of current. The amount of a driving current may vary depending on a gray scale. Therefore, a data signal may be input in order for the display panel to express a preset gray scale and compare a preset voltage level corresponding to the stored preset gray scale for the measured first power supply line. In this case, if the display panel 110 is limited to display a gray scale of 256, the display panel 110 may express a gray scale of 127 and compare the preset voltage level. If the display panel 110 displays a gray scale of lower than 127, a difference between a voltage level of the measured first power supply line VL1 and a voltage level of the preset voltage may be small and thus may not be used for compensation. Further, if a gray scale of 256 is used, when the amount of a driving current is calculated, power consumption may be increased. However, embodiments of the present disclosure are not limited thereto.

Further, in the step of calculating the compensation gain (S810), the compensation gain may be calculated by diving pixels of the display panel 110 into at least a first pixel group and a second pixel group and comparing a driving current flowing in the first pixel group with a preset amount of current. Further, the compensation gain may be calculated by comparing an accumulative driving current obtained by adding up driving currents flowing in the first pixel group and the second pixel group with the preset amount of current. Herein, the accumulative driving current may be obtained by adding up a driving current flowing in the first pixel group and a driving current flowing in the second pixel group with an adder. Thus, the magnitude of the accumulative driving current may be calculated by receiving accumulative information of first voltage information about a voltage level of a high-potential voltage transferred to the first pixel group and information about a voltage level of a high-potential voltage transferred to the second pixel group, and then the compensation gain may be calculated by comparing the accumulative driving current with preset current information. Thus, the compensation gain can be calculated using the amount of a driving current flowing in more pixels of the display panel. Therefore, the compensation gain can be calculated more accurately and the image quality of the display panel may be less degraded.

In the step of compensating the data signal (S820), the data signal may be compensated according to the compensation gain. In the compensation of the data signal, the compensation gain may be applied to a first data signal corresponding to an image signal input from the outside, and, thus, a second data signal may be generated. That is, the second data signal can be generated readily by operating the compensation gain to the first data signal. A method of applying the compensation gain may generate an image signal transferred from an external device in the form of a digital signal and an image signal compensated by operating a preset compensation gain. Herein, the image signal input from the external device may be referred to as a first data signal and the compensated image signal may be referred to as a second data signal, but may not be limited thereto. Further, the compensated image signal may be converted into an analog signal and the analog signal may be transferred through a data line.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents

What is claimed is:

1. A control circuit for a display device including a display panel and a driver integrated circuit (IC), the control circuit comprising:

an operation circuitry configured to:

calculate a magnitude of a driving current flowing in a first pixel column in response to first voltage information from the driver IC, the driver IC being configured to sense the first voltage information corresponding to a voltage level of a first power supply line, the first power supply line configured to apply a high-potential voltage (EVDD) to a first pixel group including at least one pixel of the display panel; and calculate a compensation gain by comparing the calculated magnitude of the driving current with a preset amount of current, the preset amount of current corresponding to a preset driving current; and a compensator configured to:

receive a first data signal from outside the control circuit;

generate a second data signal by applying the compensation gain to the first data signal; and transfer the second data signal to the driver IC, wherein the operation circuitry comprises an adder configured to:

receive second voltage information from a second driver IC, the second driver IC being configured to sense a voltage level of a second power supply line, the second power supply line being configured to apply a high-potential voltage (EVDD) to a second pixel group including at least one pixel of the display panel, and add the first voltage information and the second voltage information.

2. The control circuit according to claim 1, wherein the adder of the operation circuitry is further configured to:

add the first voltage information and the second voltage information to calculate the magnitude of a driving current flowing in the first pixel column and a second pixel column; and compare the calculated magnitude of the driving current with the preset amount of current to calculate the compensation gain.

3. The control circuit according to claim 2, wherein:

the operation circuitry is connected to a memory in which the preset amount of current corresponding to the preset driving current is stored; and the operation circuitry is configured to receive the preset amount of current from the memory.

4. A display device, comprising:

a display panel comprising:

a first pixel group including at least one pixel;

a second pixel group including at least another pixel;

a first power supply line configured to apply a high-potential voltage (EVDD) to the first pixel group; and a second power supply line configured to apply the high-potential voltage (EVDD) to the second pixel group;

a first driver integrated circuit (IC) configured to:

output first voltage information by sensing a voltage level of the first power supply line; and control the amount of a driving current flowing in the at least one pixel included in the first pixel group; and a control circuit configured to:

calculate a magnitude of the driving current flowing in the first pixel group using the first voltage information;

calculate a compensation gain by comparing the calculated magnitude of the driving current with a preset amount of current;

receive a first data signal from outside the control circuit and generate a second data signal by applying the compensation gain to the first data signal; and transfer the second data signal to the first driver IC, the preset current information corresponding to a preset driving current, wherein the control circuit comprises an operation circuitry comprising an adder configured to:

receive second voltage information from a second driver IC, the second driver IC being configured to sense a voltage level of a second power supply line, the second power supply line being configured to apply a high-potential voltage (EVDD) to a second pixel group including at least one pixel of the display panel; and add the first voltage information and the second voltage information.

5. The display device according to claim 4, wherein:

the operation circuitry is configured to calculate the compensation gain; and the control circuit further includes a compensator configured to generate the second data signal by applying the compensation gain to the first data signal.

6. The display device according to claim 5, wherein:

the operation circuitry is further connected to a memory in which the preset amount of current corresponding to the preset driving current is stored; and the operation circuitry is further configured to receive the preset amount of current from the memory.

7. The display device according to claim 5, further comprising:

a second driver IC configured to:

output second voltage information by sensing a voltage level of the second power supply line; and control the amount of a driving current flowing in the at least another pixel included in the second pixel group, wherein the adder is further configured to:

calculate an accumulative driving current by adding the magnitude of the driving current flowing in the first pixel group and a magnitude of a driving current flowing in the second pixel group; and compare the accumulative driving current calculated by the adder with the preset amount of current to calculate the compensation gain.

8. The display device according to claim 5, wherein the first driver IC is further configured to sense a variation in threshold voltage of the at least one pixel.

9. A driving method for a display device including a display panel that includes a first pixel group including at least one pixel, a second pixel group including at least another pixel, a first power supply line configured to apply a high-potential voltage (EVDD) to the first pixel group, and a second power supply line configured to apply the high-potential voltage (EVDD) to the second pixel group, the driving method comprising:

calculating an amount of a driving current flowing in the first pixel group by sensing a first voltage applied to the first power supply line;

sensing a second voltage level applied to the second power supply line;

add the first voltage level and the second voltage level;

calculating a compensation gain by comparing the calculated amount of the driving current flowing in the first pixel group with a preset amount of current; and compensating a data signal in response to the calculated compensation gain.

10. The driving method for a display device according to claim 9, further comprising:

calculating the amount of a driving current flowing in the second pixel group using the added first voltage level and second voltage level, wherein the calculating of the compensation gain further includes calculating the compensation gain by generating an accumulative driving current by adding the amount of the driving current flowing in the first pixel group and the amount of the driving current flowing in the second pixel group and comparing the amount of the accumulative driving current with the preset amount of current.

11. The driving method for a display device according to claim 9, wherein in the compensating of the data signal, a second data signal is generated by applying the compensation gain to a first data signal received from outside the display device.

12. The control circuit according to claim 1, wherein the operation circuitry is further configured to:

calculate the compensation gain by comparing the calculated magnitude of the driving current flowing in the first pixel group with the preset amount of current; and block a driving current flowing in the first pixel group if a difference between the amount of the driving current and the preset amount of current is higher than a preset value.

13. The display device according to claim 4, wherein the control circuit is further configured to:

calculate the compensation gain by comparing the calculated magnitude of the driving current flowing in the first pixel group with the preset amount of current; and block a driving current flowing in the first pixel group if a difference between the amount of the driving current and the preset amount of current is higher than a preset value.

14. The driving method for a display device according to claim 9, wherein the calculating of the compensation gain by comparing the calculated amount of the driving current flowing in the first pixel group with the preset amount of current further includes blocking a driving current flowing in the first pixel group if a difference between the amount of the driving current and the preset amount of current is higher than a preset value.

15. The control circuit according to claim 1, wherein the magnitude of the driving current is calculated while the display panel is driven to display an image.

16. The control circuit according to claim 15, wherein the preset driving current is determined during a manufacturing process as an amount of driving current flowing in the display panel when a variation in image quality has been adjusted by optical compensation.

17. The display device according to claim 4, wherein the magnitude of the driving current is calculated while the display panel is driven to display an image.

18. The display device according to claim 17, wherein the preset driving current is determined during a manufacturing process as an amount of driving current flowing in the display panel when a variation in image quality has been adjusted by optical compensation.

19. The driving method for a display device according to claim 9, wherein the amount of the driving current is calculated while the display panel is driven to display an image.

20. The driving method according to claim 19, wherein the preset amount of current is determined during a manufacturing process as an amount of driving current flowing in the display panel when a variation in image quality has been adjusted by optical compensation.

* * * * *